US009067605B2

(12) United States Patent
Hematian et al.

(10) Patent No.: US 9,067,605 B2
(45) Date of Patent: Jun. 30, 2015

(54) FITTINGS FOR AUTORACK RAILROAD CAR

(71) Applicant: National Steel Car Limited, Hamilton (CA)

(72) Inventors: Jamal Hematian, Burlington (CA); Ryan Duwyn, Hamilton (CA)

(73) Assignee: National Steel Car Limited, Hamilton, Ontario (CA)

( * ) Notice: Subject to any disclaimer, the term of this patent is extended or adjusted under 35 U.S.C. 154(b) by 144 days.

(21) Appl. No.: 13/666,830

(22) Filed: Nov. 1, 2012

(65) Prior Publication Data

US 2014/0116290 A1 May 1, 2014

(51) Int. Cl.

| | |
|---|---|
| ***B61D 3/18*** | (2006.01) |
| ***B61D 3/02*** | (2006.01) |
| ***B61D 17/00*** | (2006.01) |
| ***B61D 17/10*** | (2006.01) |
| ***B61F 1/02*** | (2006.01) |

(52) U.S. Cl.
CPC *B61D 3/18* (2013.01); *B61D 17/10* (2013.01); *B61F 1/02* (2013.01)

(58) Field of Classification Search
CPC ..... B61D 3/02; B61D 3/18; B61D 3/187; B61D 17/00
USPC ..... 105/404, 407, 411
See application file for complete search history.

(56) References Cited

U.S. PATENT DOCUMENTS

| | | | | |
|---|---|---|---|---|
| 1,894,534 | A | | 1/1933 | Dolan |
| 2,147,014 | A | | 2/1939 | Demarest |
| 2,432,228 | A | | 12/1947 | De Lano |
| 2,659,318 | A | | 11/1953 | Steins et al. |
| 2,929,339 | A | | 3/1960 | Schueder et al. |
| 2,959,262 | A | | 11/1960 | Parker et al. |
| 3,017,840 | A | | 1/1962 | Fairweather |
| 3,173,382 | A | | 3/1965 | Ryan |
| 3,205,836 | A | | 9/1965 | Wojcikowski |
| 3,230,900 | A | | 1/1966 | Ruprecht et al. |
| 3,240,167 | A | | 3/1966 | De Podesta et al. |
| 3,774,553 | A | * | 11/1973 | Kunst et al. ..... 105/401 |
| 3,815,517 | A | | 6/1974 | Przybylinski |
| 3,871,276 | A | | 3/1975 | Allen |
| 3,927,621 | A | | 12/1975 | Skeltis et al. |
| 4,084,516 | A | | 4/1978 | Ravani et al. |
| 4,437,410 | A | | 3/1984 | Stoller, Sr. et al. |
| 4,667,604 | A | | 5/1987 | Baker |

(Continued)

OTHER PUBLICATIONS

1997 Car and Locomotive Cyclopedia, 6th ed. (Omaha: Simmons-Boardman Books, Inc. 1997) pp. 7-24.

*Primary Examiner* — Zachary Kuhfuss

(74) *Attorney, Agent, or Firm* — Hahn Loeser & Parks LLP

(57) ABSTRACT

An autorack rail road car has an underframe having a main deck, and a rack mounted to the underframe. The rack supports one or more decks above the main deck, and also supports, or defines, an enclosure that protects the automobiles carried as lading. One way to prolong the life of the rack is to delay corrosion. Corrosion may start in locations that are difficult to clean, or that have not been cleaned prior to painting. Autorack upper decks may use longitudinally extending stringers. A stringer of closed section may be less prone to facilitating early corrosion, and may be less prone to drip rust-filled water on automobiles carried as lading. In some embodiments the stringer may be placed at a slope discontinuity in the lading deck, and may overlap that slope discontinuity.

20 Claims, 13 Drawing Sheets

(56) References Cited

U.S. PATENT DOCUMENTS

| | | | | | |
|---|---|---|---|---|---|
| 4,759,669 | A | | 7/1988 | Robertson et al. | |
| 4,924,780 | A | | 5/1990 | Hart | |
| 5,106,246 | A | | 4/1992 | Chance | |
| 5,392,717 | A | * | 2/1995 | Hesch et al. | 105/404 |
| 5,743,192 | A | | 4/1998 | Saxton et al. | |
| 5,765,486 | A | | 6/1998 | Black, Jr. et al. | |
| 5,979,335 | A | | 11/1999 | Saxton et al. | |
| 6,138,579 | A | | 10/2000 | Khattab | |
| 6,273,004 | B1 | * | 8/2001 | Klag | 105/404 |
| 6,446,561 | B1 | * | 9/2002 | Khattab | 105/355 |
| 6,551,039 | B1 | | 4/2003 | Forbes | |
| 6,659,016 | B2 | | 12/2003 | Forbes | |
| 6,871,600 | B2 | * | 3/2005 | Norton et al. | 105/404 |
| 2001/0010198 | A1 | * | 8/2001 | Forbes | 105/413 |
| 2002/0002928 | A1 | * | 1/2002 | Forbes et al. | 105/413 |
| 2003/0129037 | A1 | | 7/2003 | Forbes | |
| 2005/0031430 | A1 | * | 2/2005 | Hart et al. | 410/4 |
| 2005/0263033 | A1 | * | 12/2005 | Forbes | 105/404 |

* cited by examiner

FITTINGS FOR AUTORACK RAILROAD CAR

FIELD OF THE INVENTION

This invention relates to the field of railroad freight cars, and, in particular to the field of railroad freight cars for carrying automotive vehicles, this kind of car being referred to in the industry as an "autorack" car.

BACKGROUND

Modern autorack cars, which is to say autorack cars built since about 1975 for carrying automobiles, trucks or other vehicles in a multiple deck arrangement, have typically had the structure of a flat car underframe covered by a surface defining a main deck for supporting automotive vehicles. Most typically an upstanding elevated-deck supporting framework is mounted to the underframe. Since about 1975 the framework has usually been enclosed within, or used also to support a barn-like housing structure, which may be referred to as a closure system. Closure systems may include side screens, roof, and end closures, typically in the form of movable doors, the better to discourage thieves and vandals. This superstructure is typically referred to collectively as the "rack" of the autorack. Most typically the framework structure includes a series of vertical posts spaced along the sides of the car, with diagonal bracing or shear web panels between the posts, as may be, and one or two additional decks spaced upwardly from the main deck, and upon which respective second and third layers of automotive vehicles may be transported. That is, the rack may be a bi-level rack (i.e., a single elevated deck spaced upwardly above the main deck of the underframe) or a tri-level rack (two upper decks rather than one). The cars tend to be as tall as permitted under the applicable AAR plate clearance diagrams, for this car type, mainly Plate 'J' and Plate 'K', with maximum heights above Top of Rail or 19'-0" and 20'-3" respectively. The housing may tend to have gable ends and bridge plates that are movable to an extended position to span the gap between adjacent cars during loading and unloading. Those end closures, when open, permit circus loading of the cars, i.e., sequential loading of the automotive vehicles by driving in one end, and out the other on arrival. Although other kinds of end closures are known, most typically radial arm doors are mounted at the ends and are movable between open and closed positions to govern loading and unloading of the cars. The racks are typically replaced twice during the economic life of the autorack car underframe. That is, the old rack is removed from the underframe and replaced with a new set of racks.

Dirt and corrosion tend to be problematic in autorack service. First, replacement of the rack superstructure, or merely the deck thereof, is not an inexpensive process. The life-limiting feature of a rack may be corrosion. Rusting of the racks is problematic in two ways. First, rust is a problem for the integrity of the racks themselves. Second, and possibly more important, it is generally undesirable for the racks to drip rusty, or dirty, water on brand-new automobiles being carried as lading. Efforts have been made to limit entry of moisture in to autorack cars. Nonetheless, prevention of the onset of corrosion typically remains desirable. One of the ways to avoid early corrosion is to keep the racks clean, and to reduce the number of locations at which moisture and other contaminants may collect.

In manufacturing, welding soot may tend to collect in every crevice. An approach to this problem is to blast the structure with pneumatically conveyed shot prior to painting. However, the shot blasting process may be imperfect, and it is also desirable that the shot itself not collect in poorly accessible locations in the structure. If not removed the shot may tend to promote poor coating coverage and subsequent corrosion.

SUMMARY OF THE INVENTION

In an aspect of the invention there is an autorack rail road car deck assembly for mounting to a framework of a rack of an autorack car, said autorack car having a lengthwise rolling direction, and a direction cross-wise to the rolling direction. The deck assembly has at least a first decking member for mounting in a position supported by said framework. The decking member has undulations, the undulations being oriented cross-wise. There is at least a first stringer, the first stringer being oriented lengthwise. The first stinger has a hollow cross-section of closed periphery.

In another feature of that aspect of the invention, the first stringer has capped ends. In a further feature the first stringer is made of a roll-formed section. In still another feature the roll-formed section has ends butt-welded together. In a further feature the roll-formed section has first and second legs that are roll-formed inwardly to lie next against each other, and an external weld is formed along a seam where the two legs meet. In yet another feature the first stringer includes at least a first member and a second member, the first and second members co-operating to form respective first and second portions of the closed periphery of the hollow cross-section. In a yet further feature, the first member defines an open-section member having opposed first and second longitudinally running margins, and the second member defines a closure plate welded across the margins to close the section.

In another feature, the stringer is substantially triangular in cross-section. In still another feature the first decking assembly has an upper surface over which wheeled vehicles may be conducted, and an opposed underside facing downwardly, and the first stringer is mounted on the underside of the first decking assembly. In yet still another feature the first decking assembly includes the first stringer and a second stringer, and the first and second stringers are mounted to the deck member in a lengthwise-running, cross-wise spaced-apart symmetrical arrangement. In again another feature the undulations of the first decking member define corrugations, the corrugations being oriented cross-wise, and the stringer is mounted to an underside thereof, the stringer running square to the corrugations. In still another feature the closed periphery includes a first portion for placement in mating engagement with the first decking member, and the first portion of the closed periphery includes a first part and a second part, there being slope discontinuity as between the first part and the second part. In yet another feature the first and second parts co-operate to form a reflex angle in the profile.

In again another feature the first deck member defines a roadway over which to conduct wheeled vehicles in the lengthwise direction. There are at least first and second stringers. The first deck member has a central portion and first and second side margins, the first and second side margins running lengthwise along the central portion. The first and second side margins each meeting the central portion at respective first and second slope changes in the first decking member in the cross-wise direction. The first stringer undergirds the first slope change of the first decking member. In still another further feature the central portion of the deck member is crowned. The side margins meet the central portion at respective first and second transitions. The first and second side margins are mated to the central portion such that the side margins extend in a common, substantially horizontal plane. The first and second stringers overlap the first and second transitions, respectively. In yet another feature each of the first and second stringers has a first portion having a reflex angle formed therein to mate with the transition associated therewith.

These and other aspects and features of the invention may be understood with reference to the description which follows, and with the aid of the illustrations.

BRIEF DESCRIPTION OF THE FIGURES

The description is accompanied by a set of illustrative Figures in which.

DETAILED DESCRIPTION

Figure 1A:
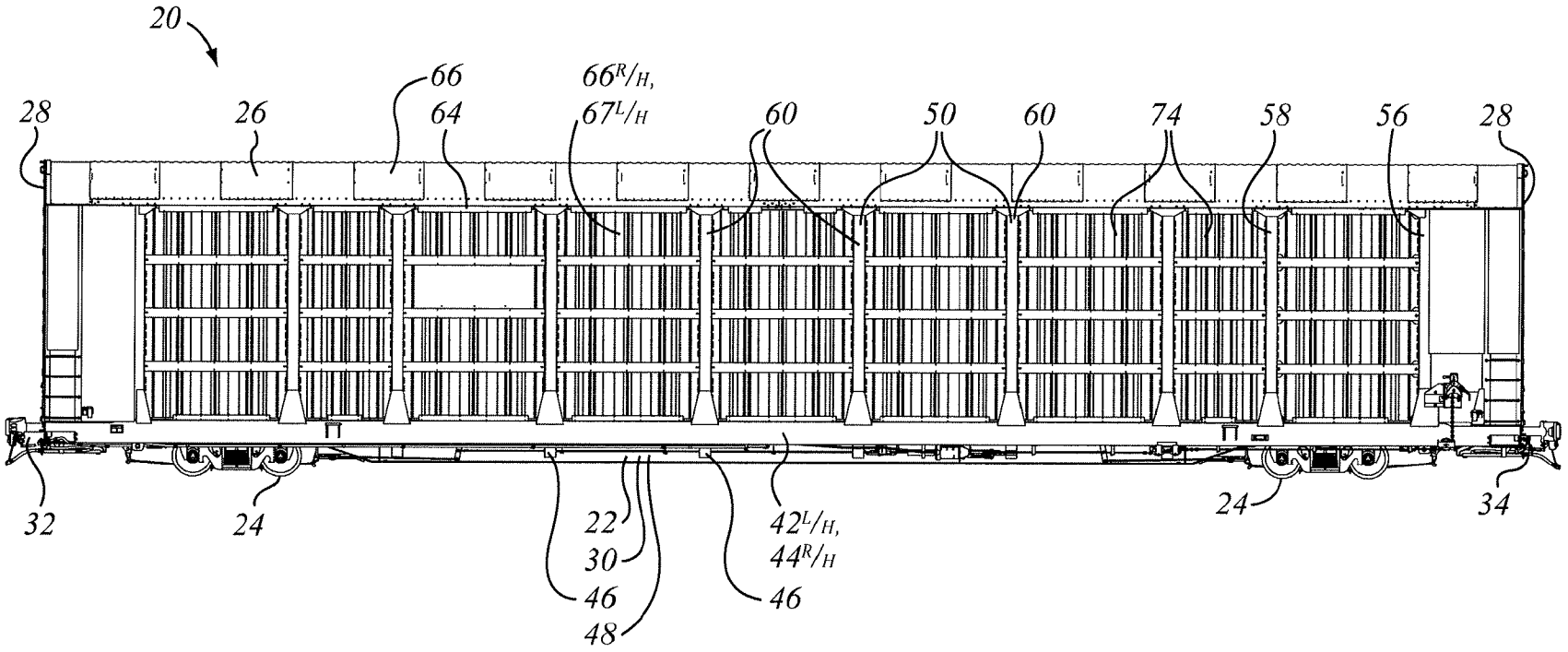
FIG. 1*a* is a general arrangement, side view of an autorack railroad car according to an aspect of the invention.
Figure 1B:
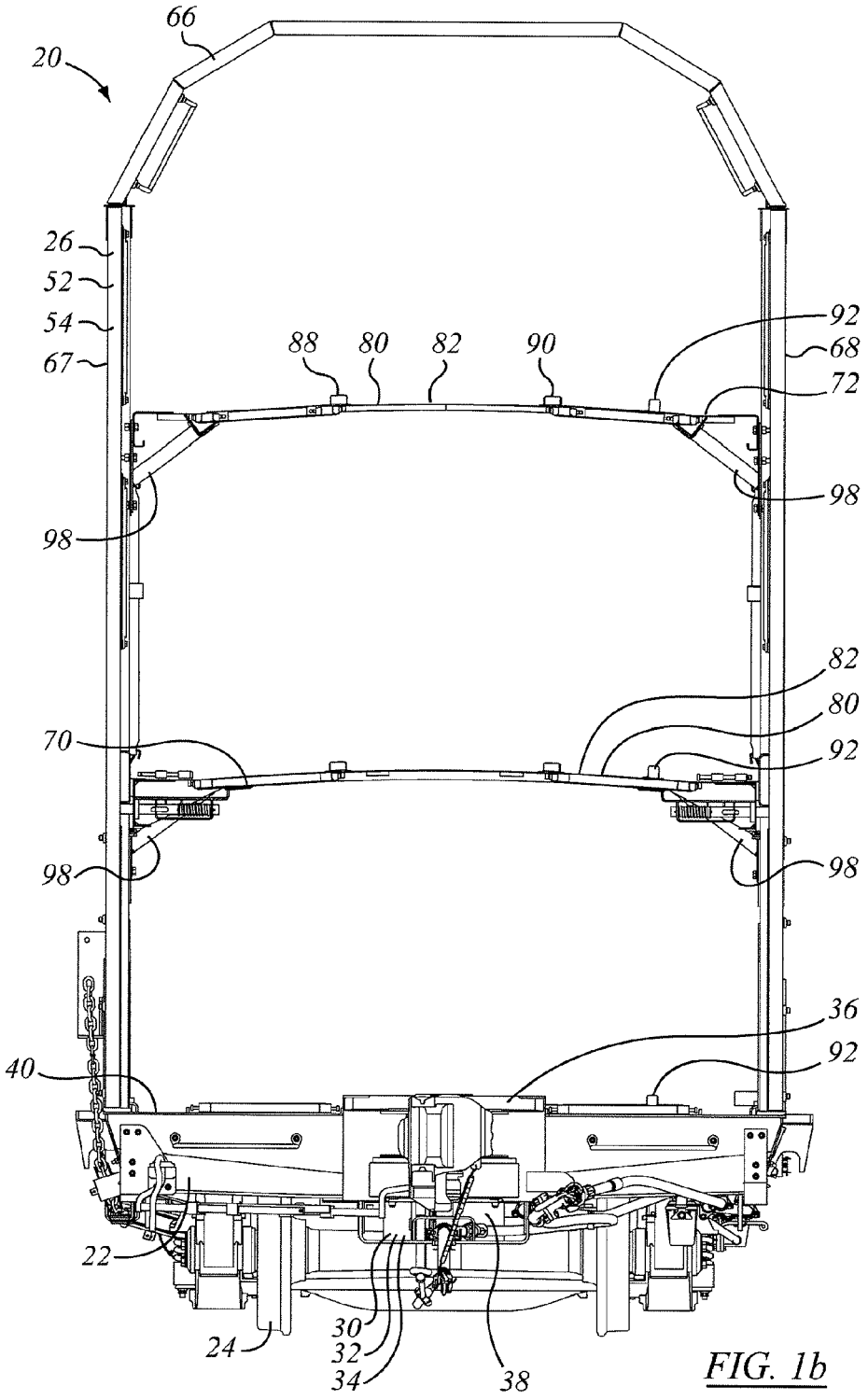
FIG. 1*b* is an end view of the autorack railroad car of FIG. 1*a;*
Figure 1C:
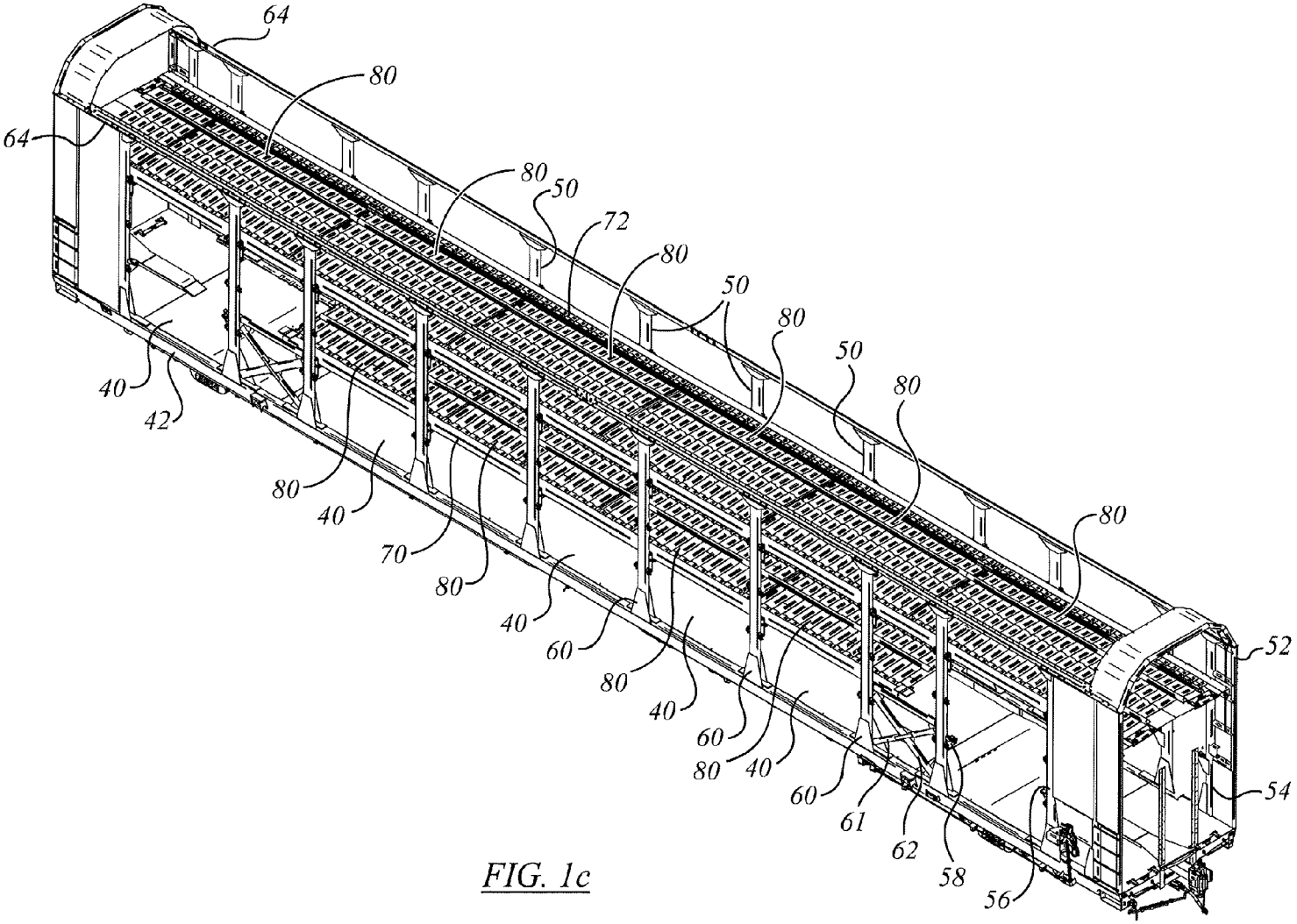
FIG. 1*c* is an isometric view of the autorack railroad freight car of FIG. 1*a* without trucks; with housing side panels and roof panels removed to show internal structure, and with the end portions of the mid-level deck removed.
Figure 1D:
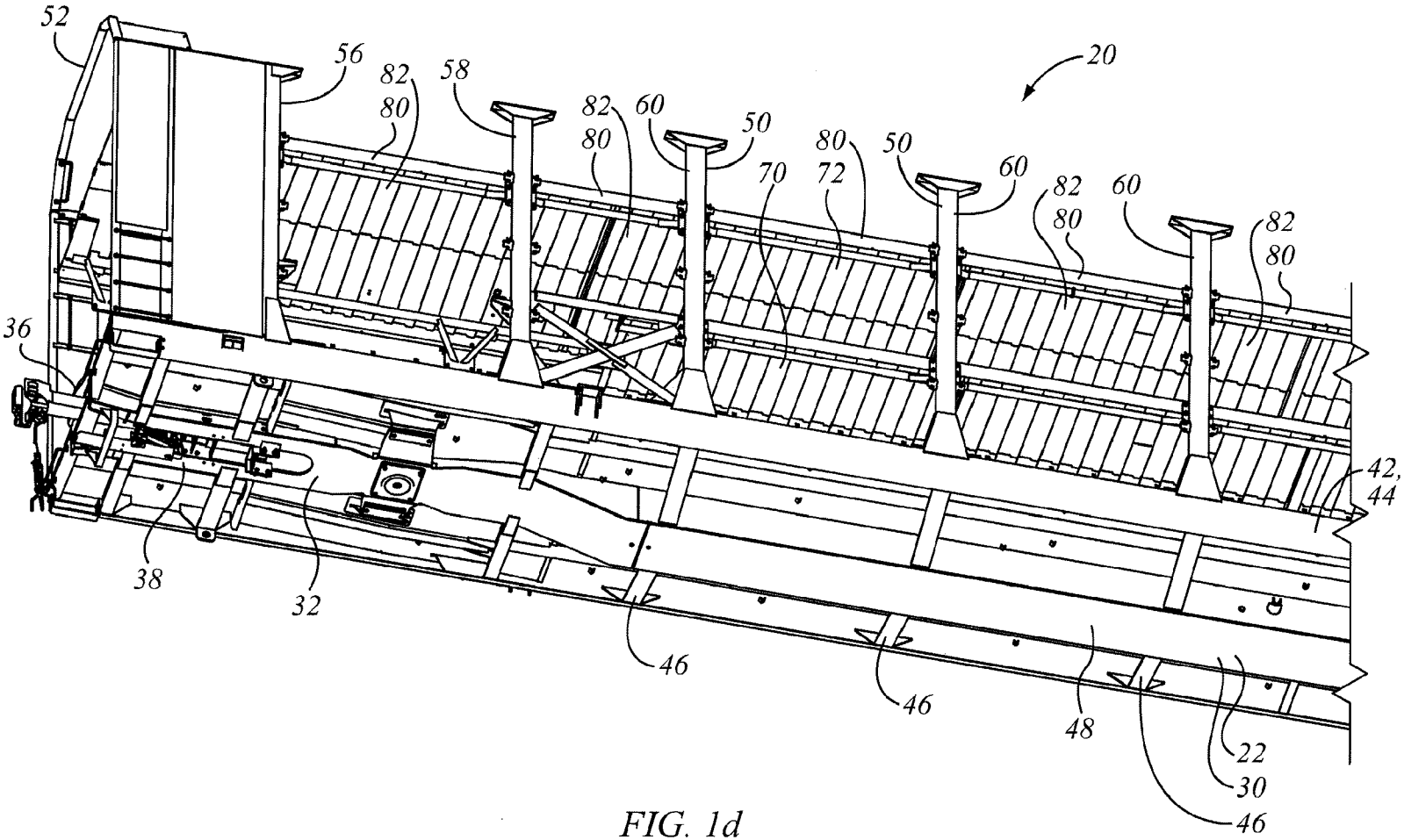
FIG. 1*d* is a perspective view, from below, of one half of the autorack railroad car structure of FIG. 1*c;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology used in this specification is thought to be consistent with the customary and ordinary meanings of those terms as they would be understood by a person of ordinary skill in the rail road industry in North America. The Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record, (for example, earlier publications by persons not employed by the USPTO or any other Patent Office), demonstrating how the terms are used and understood by persons of ordinary skill in the art, or by way of expert evidence of a person or persons of at least 10 years' experience in the rail road industry in North America or in other former territories of the British Empire and Commonwealth.

In terms of general orientation and directional nomenclature, for rail road cars described herein the longitudinal or lengthwise direction is defined as being coincident with the rolling direction of the rail road car, or rail road car unit, when located on tangent (that is, straight) track. In the case of a rail road car having a center sill, be it a stub sill or a straight-through center sill, the longitudinal direction is parallel to the center sill, and parallel to the top chords and side sills, as may be. Unless otherwise noted, vertical, or upward and downward, are terms that use top of rail, TOR, as a datum. In the context of the car as a whole, the terms cross-wise, lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than". The directions correspond generally to a Cartesian frame of reference in which the x-direction is longitudinal, the y-direction is lateral, and the z-direction is vertical. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, a description of one half of the car may generally also be intended to describe the other half as well, allowing for differences between right hand and left hand parts. In this description, if used, the abbreviation kpsi stands for thousands of pounds per square inch.

In this discussion it may by understood that persons of ordinary skill in the art are familiar with the Rules and Standards of the Association of American Railroads (the AAR), which govern interchange service in North America. This specification or the accompanying illustrations may refer to standards of the Association of American Railroads (AAR), such as to AAR plate sizes. To the extent necessary or appropriate, those references are to be interpreted in a manner consistent with the Rules and Standards as extant on the earliest of the date of filing of this application or the date of priority of the earliest application from which this application claims priority, as if they formed part of this specification on that date.

Also for the purposes of the present discussion, it may be taken as a default that the structure of the car is of all-welded mild steel fabrication except as otherwise shown in the illustrations or indicated in the text. This need not necessarily be the case. Other materials, such as aluminum or stainless steel might be used. The rack structure may also be taken as being of steel fabrication, although, again, aluminum or stainless steel might be used, and the side web panels or side screen panels of the car, which may be made of mild steel, stainless steel, or aluminum might also be made from plastic composite material, which may be reinforced composite.

In FIGS. 1*a*-1*d*, an autorack rail road car is shown generally as 20. It has an underframe, or underframe assembly, indicated generally as 22, that is carried upon railroad car trucks 24 for rolling motion in a longitudinal or lengthwise direction along railroad tracks. Underframe 22 is surmounted by an enclosure system which may have the form of an overspanning housing structure indicated generally as 26, and which may be referred to as "the rack" of the car. The ends of housing structure 26 are open to permit loading and unloading of automotive vehicles. Ingress and egress of those vehicles is governed by a pair of end closures, 28, such as may be radial arm doors or multiply-folding movable between open and closed positions.

Underframe 22 has a center sill 30. Center sill 30 is a "straight through" center sill that runs substantially entire length of the car between first and second ends 32, 34 at which strikers 36 are mounted. The main deck 40 extends to either side of the center sill to the sides of the car at side sills 42, 44. The term "straight through" is used in distinction to stub center sills such as used in, e.g., grain cars, where the center sill at each end of the car is truncated inboard of the center plate to leave a "stub", namely the center plate and draft sill assembly. In a straight through center sill, the center sill extends from one truck center to the other. The outboard portions of the center sill may be identified as the draft sills 38 in which the draft gear and couplers are mounted. Draft sills 38 are extensions of center sill 30 that extend longitudinally outboard of (and often include) the truck center to the striker 36.

Side sills 42, 44 run lengthwise along either side of underframe assembly 22, and are structurally connected to center sill 30 by an array of laterally extending structural members 46 which may include cross-bearers 48 and cross-ties (not shown). A cross-bearer is a beam having a first end connected to the center sill at a connection that is intended to be capable of transmitting a bending moment, such that the cross-bearer is also a cantilever that has its root, or built-in end at the center sill. The second end or distal end or transversely outboard end of each cross-bearer is connected to the associated side sill running along that side of the car. The side sills are themselves beams, typically of hollow or open section, formed with an upper flange, a lower flange, and a medial portion that functions as a web to carry shear between the upper and lower flanges. Side sills may sometimes have a somewhat C-shaped section, with the open part of the C facing toward the center sill and the webs of the cross-bearer and cross-ties extending into the C and forming a connection.

Main deck 40 typically extends across the car from side sill to side sill and from end to end of the car, and provides a driving pathway for wheeled vehicles, i.e., the lading for this kind of car. Main deck 40 is supported by side sills 42, 44, center sill 30, cross-bearers 48 and such cross-ties as may be, and may form the top flange of one or more of them. In the example illustrated, for example, main deck 40 forms, or is substantially flush with the top cover plate (i.e., top flange) of center sill 30, over most or all of its length e.g., excluding draft sills 38. The main deck may also form the top flange of the cross-bearers 46 and cross-ties (if any). The main deck is open at the ends (i.e., the curbs defined by the side sills only run along the sides) such that wheeled vehicles may be end-loaded.

Looking at the framework of the rack structure 26, the rack structure 26 includes an array, or a series, of upstanding posts 50. That are spaced along the left and right hand sides of the car, i.e., along, and standing upwardly of, side sills 42 and 44 respectively. There is an end framing structure, indicated as 52, that extends upwardly from the ends of the end sill, and which defines the shape of the gable end. Next inboard is "the first post", an upright side post 54 that runs between the side sill and the top chord at the station of the first lateral cross-members. Next inboard are posts 56, mounted at the ends of the first lateral frame (i.e., outboard of the truck center), and posts 58, mounted near the ends of the second lateral frame member inboard of the truck center. Posts 60 are mounted further inboard at the ends of the respective cross-bearers 46 that extend laterally of central portion 48 of center sill 30. Diagonal shear bracing 61, 62 is mounted between main posts 58 and next longitudinally inboard posts 60. Longitudinally running left and right top chords 64 run along, and tie together, the tops of all of posts 54, 56, 58, and 60 as may be. The roof structure 66 is mounted atop top chords 64 and restrains them in the lateral direction, and provides a lateral shear connection between the left and right hand side walls 67, 68 of the car. This framework and the stringer form a truss structure that cooperates with the truss structure of the sidewall posts. The framework may support one or more elevated decks, such as a second or mid-level deck 70, and a third or upper deck 72. The structure may include sidewall screens of sidewall panels 74 that are mounted between the various posts and that may tend to act as shear panels between those posts and between side sills 42, 44 and the respective top chords 64.

When the replaceable rack structure of posts and braces and top chords is in place, the high longitudinal members act as chords of a truss more than 10 ft. distant from the side sills. This deep truss structure provides the car with the resistance to vertical bending required when carrying lading in service. As noted above, the underframe is intended to define, and to be, permanent structure of the autorack car, whereas the racks may have roughly one third the life of the underframe. That is, the underframe may be provided with a first set of racks when new, and then with a further two sets of replacement racks during the car's lifetime.

Figure 2A:
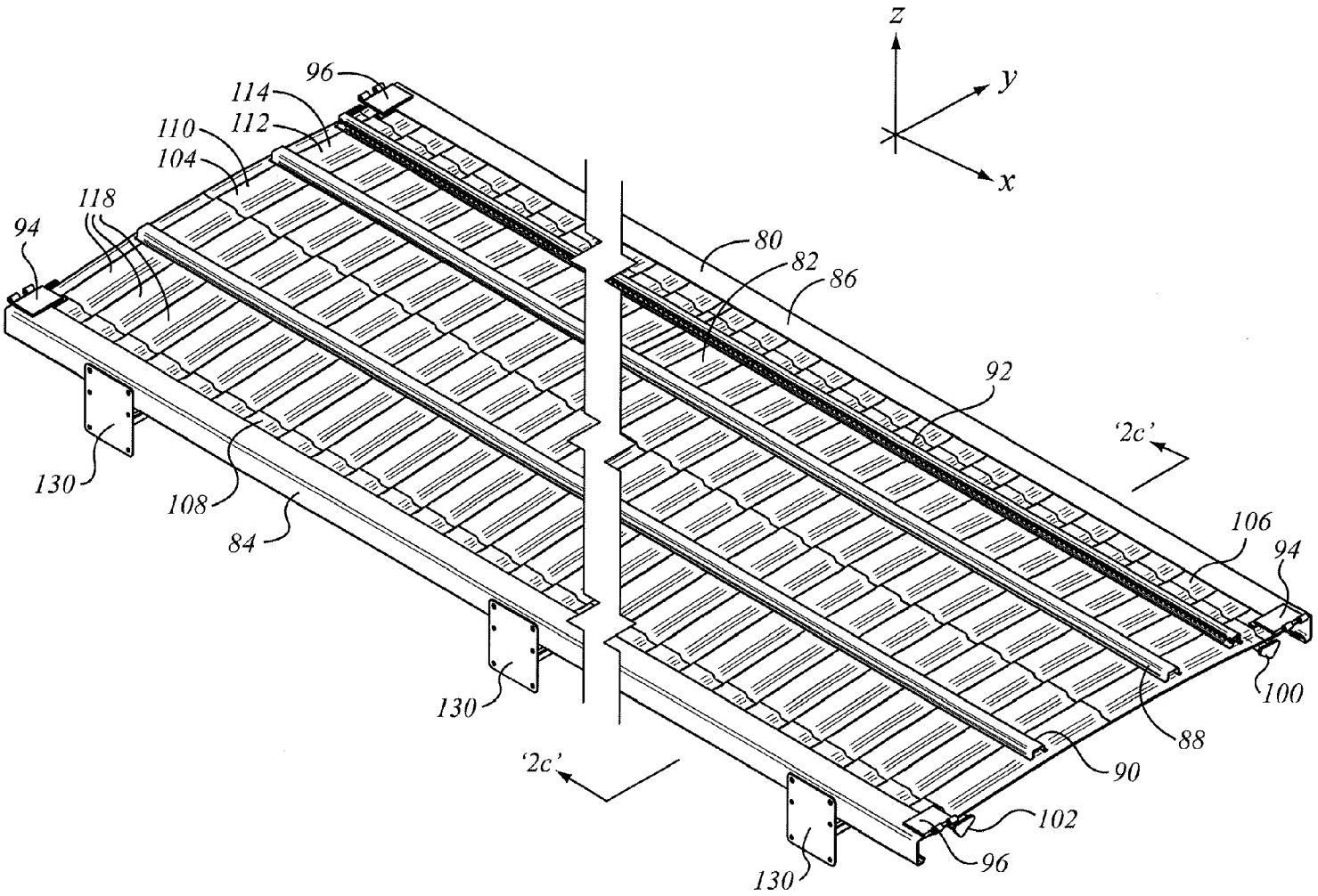
FIG. 2*a* is an isometric view of a section of deck for use in an autorack railroad car such as that of FIGS. 1*a*, 1*b*, 1*c* and 1*d;*
Figure 2B:
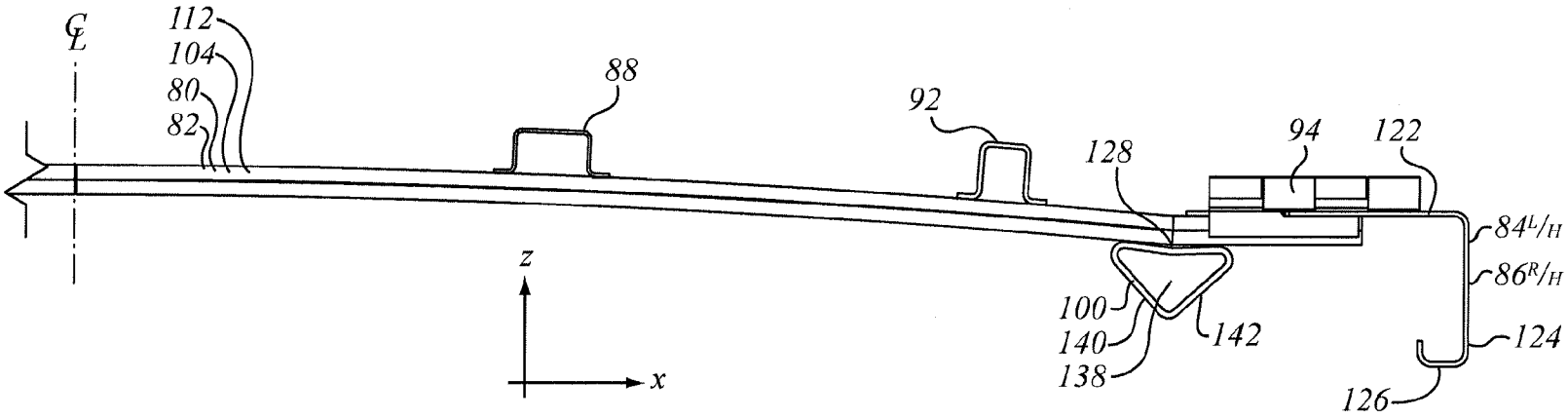
FIG. 2*b* is a half end view of one half of the section of deck of FIG. 2*a;*
Figure 2C:
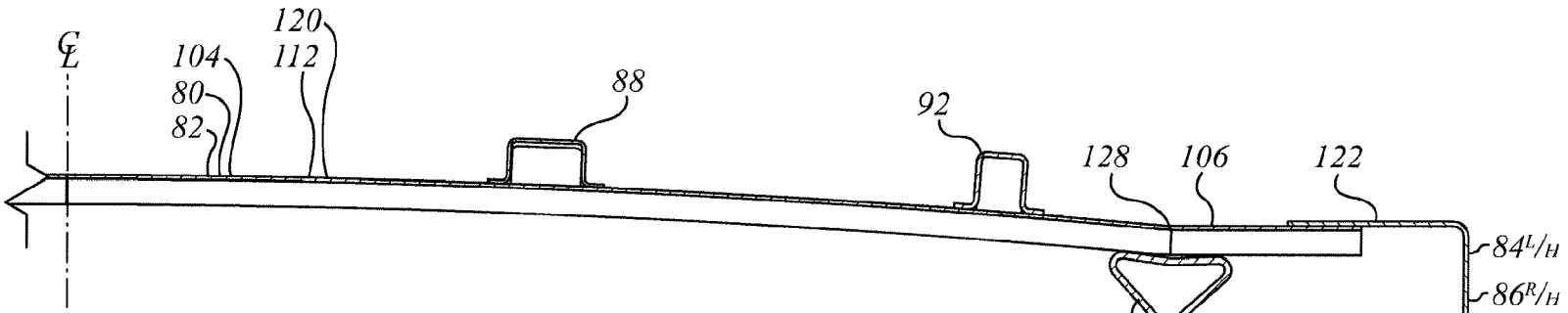
FIG. 2*c* is a half sectional view taken on "2*c*-2*c*" of the section of deck of FIG. 2*a;*
Figure 2D:
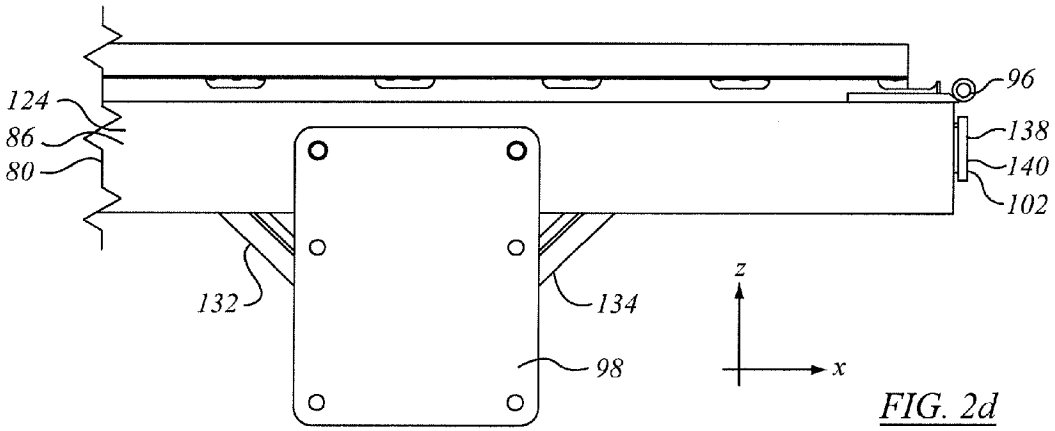
FIG. 2*d* is a side view showing a detail of the deck assembly of FIG. 2*a;*
Figure 2E:
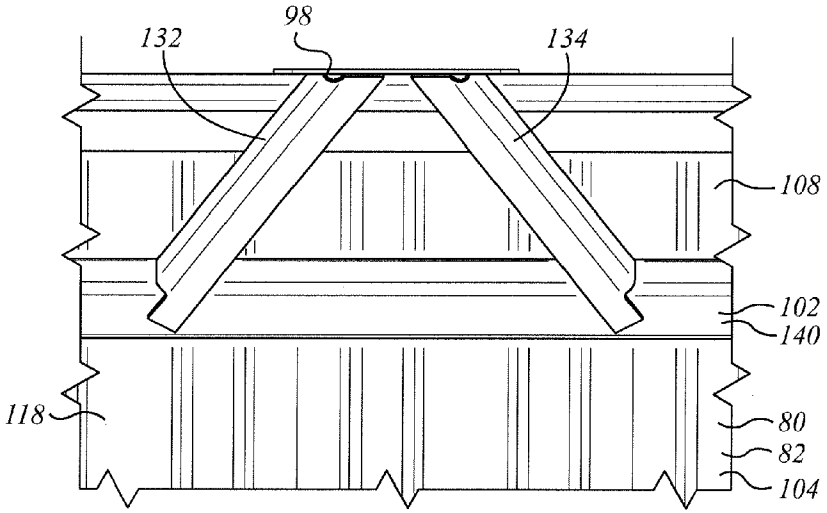
FIG. 2*e* is an upwardly looking view of the detail of FIG. 2*d;*

The rack structure of the elevated deck or decks includes a set of deck panels, or deck panel assemblies, of which a representative one is shown in FIG. 2*a* as deck panel assembly 80. Other than as noted, assembly 80 is symmetrical about the longitudinal vertical (i.e., x-z) centerline plane of the rack, and spans the open space between the left and right hand sidewall support structure of car 20. It may also be noted that deck panel assembly 80 may be manufactured in different lengths, and a set of deck panels 80 is installed to define a full length deck of car 20, be it deck 70 or deck 72. As may be appreciated, each of deck panels 80 may be replaced as an individual module if damaged or corroded, or in need of replacement or repair for whatever reason. Deck panel assembly 80 includes a main, or first, decking panel 82, first and second, (or left and right) side beams or rails 84, 86, first and second, or left and right, upper longitudinally running members 88, 90; a vehicle placement securement fitting, or fitting array 92, hinge fittings 94, 96, and first and second, or left and right hand, longitudinally extending underside stringers 100, 102.

Main decking panel 82 may include a central portion 104 and left and right hand edge or margin portions 106, 108. Main decking panel 82 may have an upper surface 112 which defines a roadway, or pathway, or track 114 over which wheeled vehicles may be conducted in the lengthwise direction (or x-direction) in the normal procedure of loading and unloading vehicles in autorack cars. Main decking panel 82 may also have an underside, or downwardly facing surface 116 that faces toward the next lower deck, be it the middle deck (in the case of an upper decking panel) or the rail road car main deck 40 of underframe 22. As installed, main decking panel is spaced upwardly from the next lower deck by a distance commensurate with the carrying of another layer of vehicles on the deck therebelow. Main decking panel 82 may have an undulating form, with up-and-down undulations in the vertical direction made to increase its effective depth of section and therefore its second moment of area for resistance to bending. The undulations may run cross-wise, namely in the lateral, transverse, left-to-right, or y-direction. The undulations run in the direction generally cross-wise to the lengthwise running direction of main decking panel 82 generally, and also of pathway 114. The undulations may have the form of corrugations 118.

Central portion 104 may be formed as a single section, or may be formed by welding two left and right halves together. In that context, the left and right halves may be identical, but reversed and welded together along a central seam. Central portion 104 may be formed on a curvature such that it has an arcuate crown 120, of which the crest is at, and runs along, the longitudinally running centerline. The downwardly and outwardly sloped margins or edges of central portion 104 meet, and are joined to, left and right hand margin portions 106, 108. The junction of these components may be formed by welding. Margin portions 106 and 108 are oriented horizontally. That is, if decking panel 82 is placed on a flat surface, margin portions 106 and 108 will lie in a common horizontal plane, which central portion 104 deviates convexly arcuately away from that plane.

Side beams, or rails, 84, 86 run in the lengthwise direction along margin portions 106, 108. Each side beam 84, 86 has a first leg 122 that extends substantially horizontally, a second leg 124 that extends substantially vertically, and a roll-formed lower flange 126 which is located distant from first leg 122. In this way first leg 122 functions as an upper flange, and second leg 124 functions as a vertical shear web. The distal portion of first leg 122 that is most distant from second leg 124 overlaps, and is welded to, a respective one of margin portion 106 or 108. The corrugations of margins 106, 108 extend downwardly of first leg 122. The ends of portions 106, 108 terminate inboard well clear of second leg 124, and are offset laterally inboard relative to flange 126, such that a water drip falling straight down from an open corrugation end would drop clear of flange 126.

Longitudinally running members 88 and 90 are mounted to the upwardly facing surfaces of the corrugations, symmetrically to either side of the centerline of crown 120. Members 88 and 90 may have the form of open structural section members, and in one form may be inverted channels or top-hat sections with the toes of the legs mated to surfaces 112 of the successive corrugations. Members 88 and 90 may function as upper, longitudinal flanges of deck panel assembly 80. They may also function as upstanding guideways, or curbs, for wheeled vehicles being conducted along deck panel assembly 80. To the extent that the open section faces downward, and is self-draining, it is not a place where moisture, dirt, or other material may tend to collect.

Securement fitting 92 may have the form of a locking rail spaced laterally outboard from member 90. Securement fittings may be placed on both sides of the centerline of deck panel assembly 80, however, in the embodiment shown only a single securement fitting rail is shown, it being a non-symmetrical feature of an otherwise symmetrical assembly. The apertures formed in the inboard upstanding leg of securement fitting 92 provide engagement points for wheel lock-down apparatus, or chocks, used to prevent motion of wheeled vehicle lading during operation of railcar 20.

Hinge fittings 94 and 96 may mate with corresponding hinge fitting of adjacently placed movable decks or bridge plates, as may be. Mounting bracket assemblies 98 define the mounting interfaces at which deck panel assembly 80 is connected to the side post array, and thus suspending in an overhead spanning position relative to any lower deck or decks.

Underside stringers 100 and 102 may be mounted to the underside, or downwardly facing surface 116 of the successive corrugations of main decking panel 82. They may be placed laterally outboard of respective upper longitudinally running members 88, 90. They may be placed laterally closer to side beams 84, 86 than to members 88, 90. Each may be placed adjacent to a respective slope discontinuity 128 at the junction of central portion 104 and each of side portions 106 and 108. Underside stringers 100, 102 may each be placed to overlap slope discontinuity 128, thereby to provide reinforcement at what might otherwise be a location of weakness in the panel.

Mounting bracket assemblies 98 may include fittings such as mounting plates 130, which may be substantially rectangular and which may define a mounting foot of deck panel assembly 80. They may have pre-bored holes that locate on the upright posts, as may be. Diagonal reinforcement, or braces, or load spreading members 132, 134 may be positioned with one end rooted to plate 130, and a distant end attached to main decking panel 82 or to one of underside stringers 100, 102.

In the past, stringers for autorack decks have been made with an L-shaped piece of steel, and angle iron, installed with its toes upward, mounted to the underside of the deck sheet. When thus mounted, the stringer forms a trough that may be liable to collect dirt and debris, particularly during the shot blast process prior to painting where the trough may tend to function as a shot trap. When debris or other material of this nature remains in the trough, it subsequently may be a rust initiation site, and may cause or hasten premature rusting of the rack. Further, where rusting occurs, and there is moisture in the car, whether from collection of rain or snow, dripping of automobiles when loaded, or from condensation overnight, the rusty water may drip on the automobiles carried as lading within the autorack, thus potentially ruining their finish. Shot that collects from the blast process, as well as dust, dirt and debris from ordinary usage, should be removed. It is a painstaking task. The process may be difficult due to either lack of access or poor access. It is generally desirable to need to spend less time cleaning after blast, and to deliver a cleaner product. By replacing the L-shaped stringer with a closed section, the trough is covered. A closed stringer prevents shot, dust, and dirt from being collected, greatly simplifying cleaning. This may tend to discourage or prevent the collection of debris therein. This in turn may reduce or eliminate the need for cleaning, and may reduce or delay the onset of rusting of the stringer. Having a closed stringer may tend to prevent it from trapping dirt, and hence to reduce the need for regular cleaning, or to allow longer intervals between cleaning. Having a cleaner autorack may tend to allow them to deliver automobiles with less dirtying and damage.

Several embodiments of a closed stringer are shown and described herein. This includes typical L-channels with closure plates welded either on top or inside; a roll-formed profile with continuously welded seam; and standard hollow structural sections.

Figure 3A:
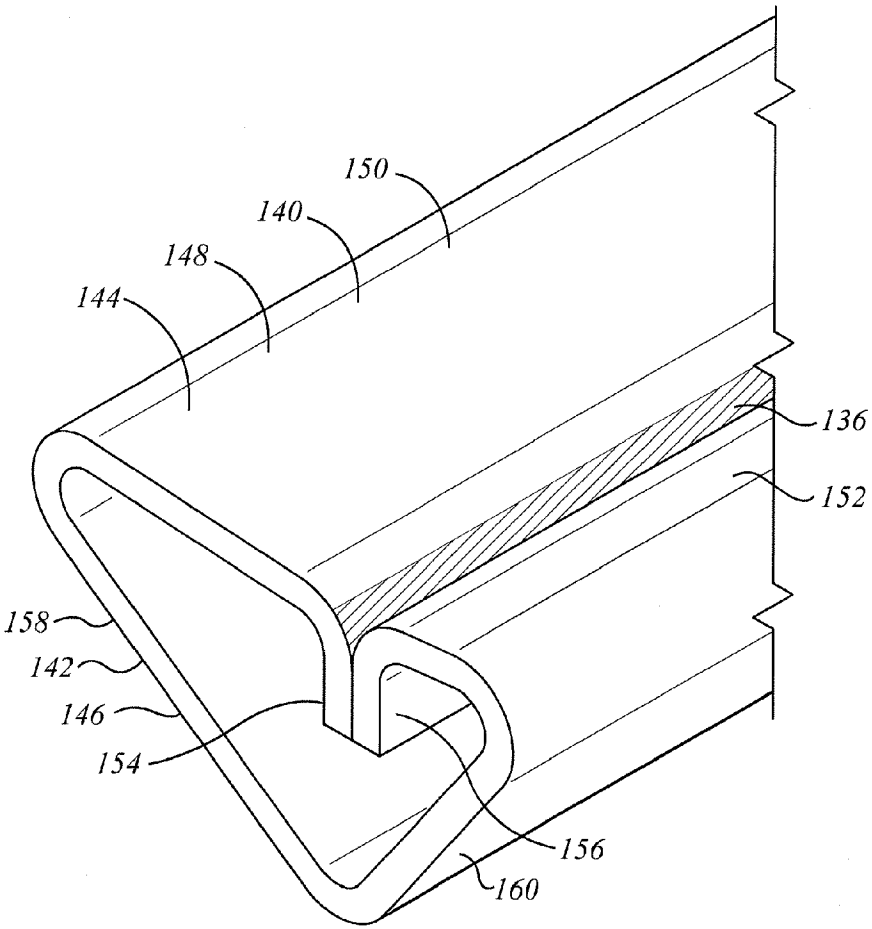
FIG. 3*a* is an isometric view of a stringer of the deck assembly of FIG. 2*a;*

In FIG. 3*a* a stringer, be it 100 or 102, is shown as 140. Stringer 140 runs the length of deck panel assembly 80. As may be noted stringer 140 has an external wall section 142 that defines a periphery, that is, when oriented as installed, closed at the top side as at 144, such that water may not tend to collect in stringer 140, and such that blast shot may also tend not to collect. The periphery may be closed all-around such that the section is a closed hollow structural section. The external wall 142 includes not only the top side or part or portion, but another portion 146 that forms the remainder or balance of the closed section. Further aiding in closing the section, stringer 140 may be closed at its ends, as, for example, by end caps 138 such as may be welded or otherwise fixed in place.

Figure 3B:
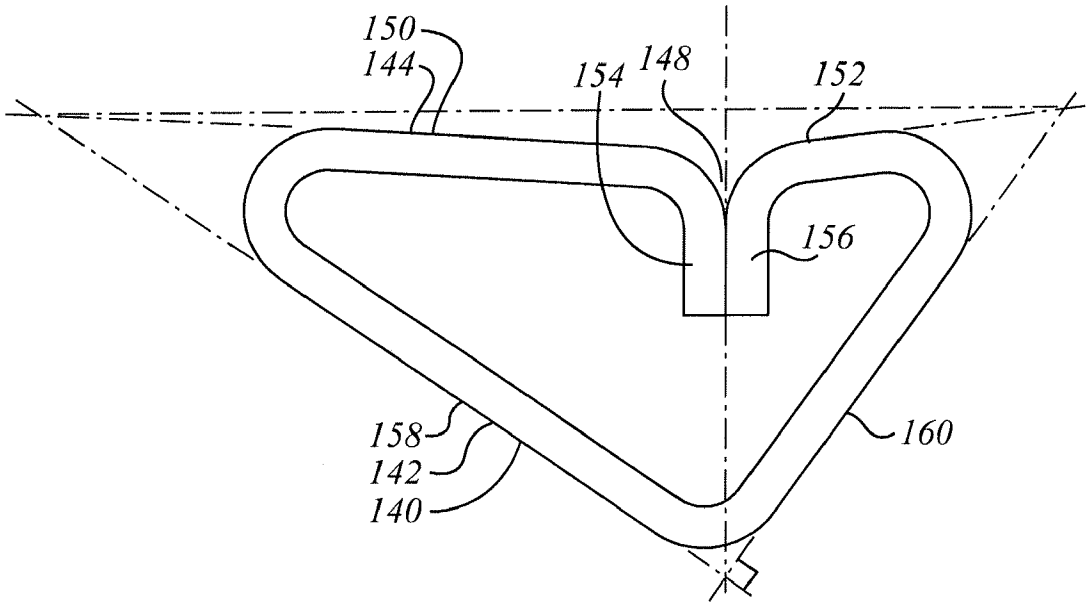
FIG. 3*b* shows an end view of the stringer of FIG. 3*a;*

The closed section may have a multitude of different possible forms. It may be substantially circular, or square, or rectangular, or D-shaped. In the examples shown it may be substantially three-sided or triangular. The sides or parts, or portions need not be planar, i.e., linear as viewed in section. However many sides there are, and whether those sides be straight or not, the upper part may provide a surface, or seat, such as at 148 for mating engagement with the underside of main decking panel 82. In the embodiment illustrated in FIGS. 3*a* and 3*b*, top side 144 has a kinked or dog-legged, or gull-winged, or reflex angle shape, there being first and second parts 150 and 152 of top side 144, parts 150 and 152 meeting at an internal angle that exceeds 180 degrees, the angle and shape being suited to seat next to, to accommodate, or to conform to, the slope change, or slope discontinuity, at the transition or junction between central portion 110 and one or the other of margin portions 106, 108 of main decking panel 82. Top side 144 need not be horizontal, but may be on a slant, such that it may not be the "top" of stringer 144, but may be the uppermost side thereof. In the example of FIGS. 3*a* and 3*b*, parts 150 and 152 may be substantially planar. The end portions, or legs 154, 156 of parts 150 and 152 may be roll formed such that they curl inwardly next adjacent to each other. Where the radii of the back of legs 154, 156 come together, a fillet weld is formed along stringer 140 as indicated at 136. The fillet weld may lie shy of (i.e., below), or flush with the planes of parts 150 and 152 so as not to impede mounting of stringer 140 next to the transition of main decking panel 82. As can be seen, in this embodiment top side 144 overlaps the slope change discontinuity in main decking panel 82. In this embodiment, in which stringer 140 is substantially triangular in section, top side 144 may be the long side, and the other two sides are identified as second side 158 and third side 160. Second and third sides 158 and 160 may meet at a right-angled corner. Any or all of the vertices of the section may be radiused, as indicated.

In other embodiments, top side 144 need not be kinked or dog-legged, but may be straight as viewed in section (such that top side 144 is planar), or may follow an arc such as may correspond to main decking member 82 and the slope change therein. Further, stringer 140 need not be placed at, or overlap the slope change discontinuity in main decking panel 82, or at the junction of the margins of portion 104 with 106 or 108 as may be. Stringer 140 could be placed to either side of that junction, either undergirding portion 104 or either of portions 106 and 108.

Figure 3C:
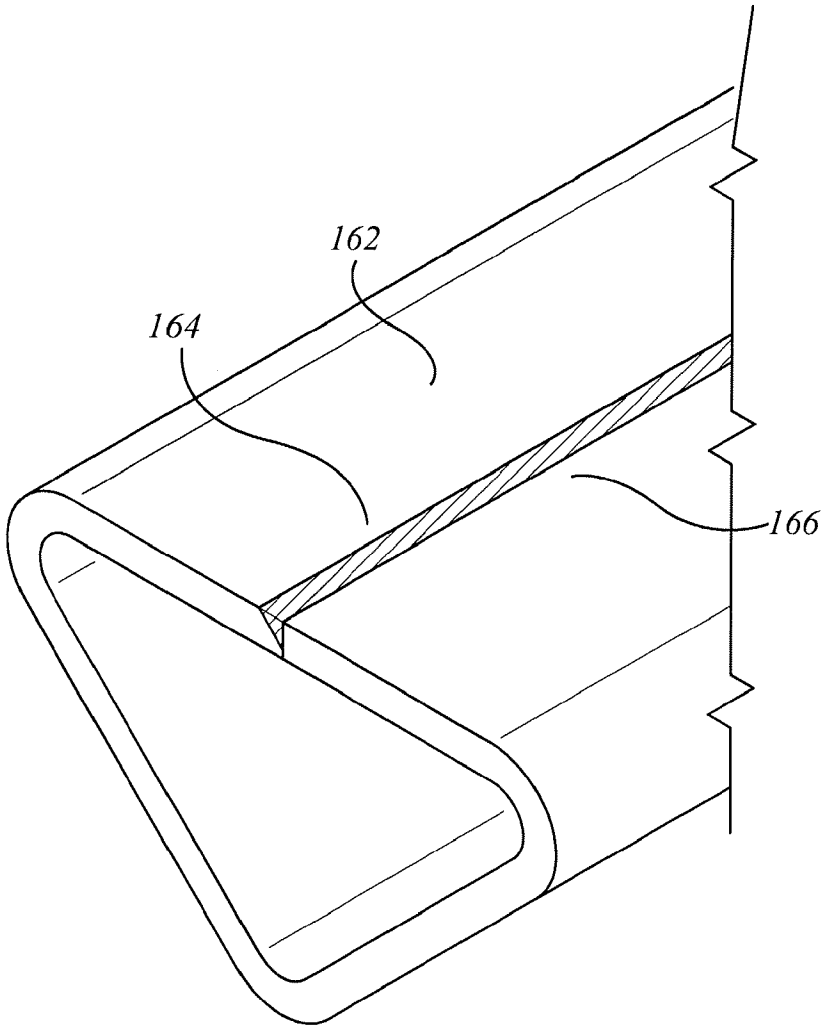
FIG. 3*c* shows an alternative stringer to that of FIG. 3*a;*
Figure 3D:
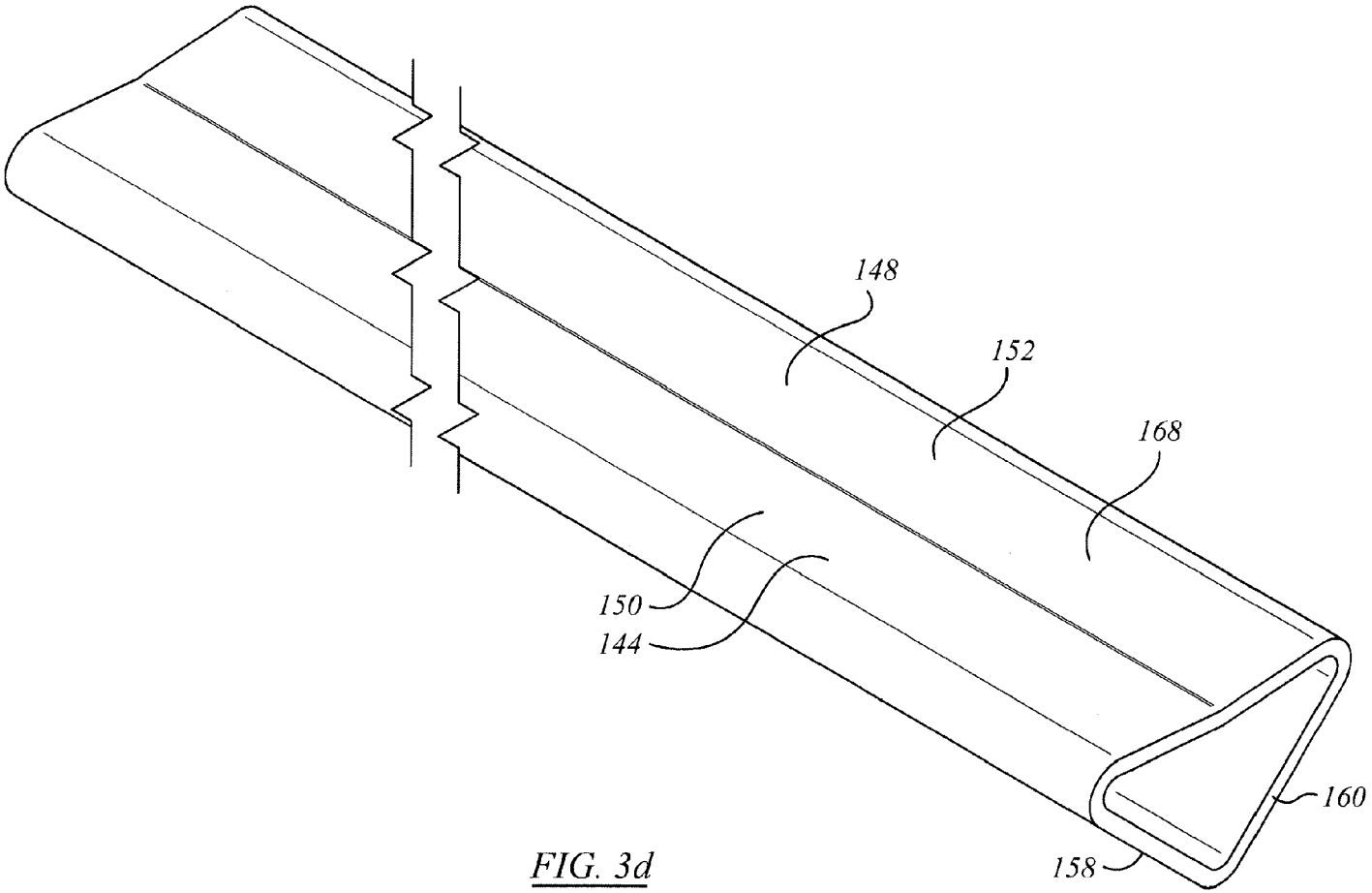
FIG. 3*d* shows a further alternative stringer to that of FIG. 3*a;*

While stringer 140 may be made of a roll-formed section with re-entrant legs, as shown in FIGS. 3*a* and 3*b*, it may also be formed as a roll-formed section 162 in which toes 166, 168 are butt-welded together, as in FIG. 3*c*; or may be a seamless steel section 170 as shown in FIG. 3*d*, which may have sides corresponding to those described above.

Figure 3E:
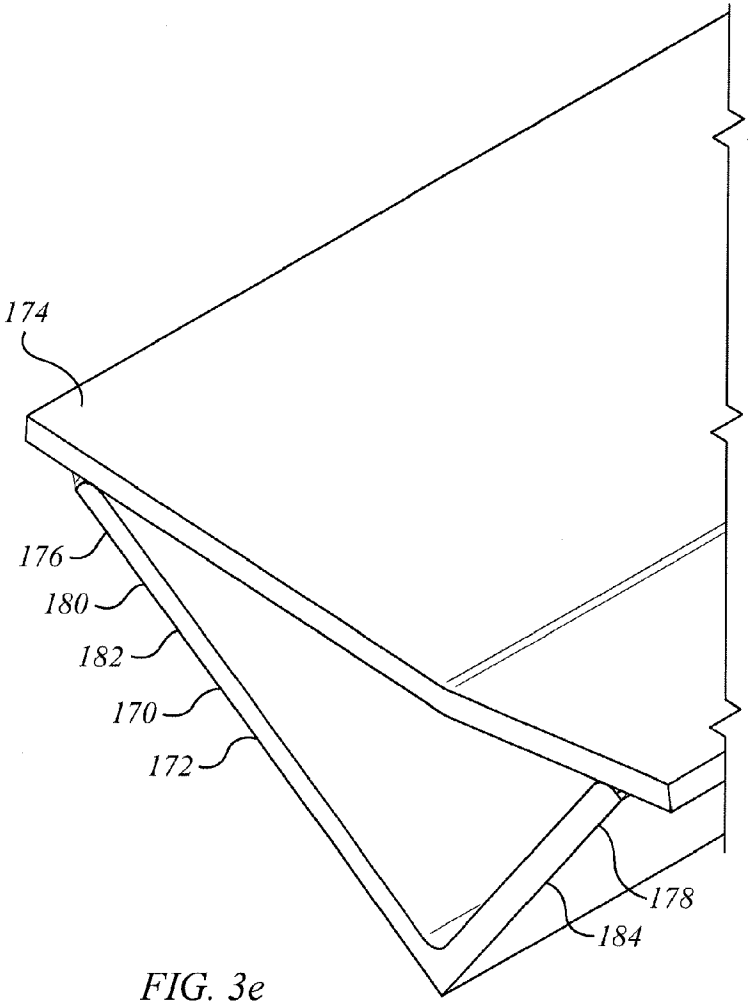
FIG. 3*e* shows an alternative stringer to that of FIG. 3*a*.

In the alternative of FIG. 3*e*, stringer 140 may have the form of a two (or more) part section 170, in which there is a structural member 172 which has a hollow or formed structural section, but in which that section is open. A second portion 174, which may be a cap plate, is welded across toes 176, 178 of member 172, thus forming a closed section. As may be understood, this is done prior to mounting of stringer 140 to main decking panel 82, such that the section is closed prior to welding, shot blasting and painting. Although structural member 174 may be a channel or other multi-sided or circular or other form, in FIG. 3*e* it may have the form of an angle iron 180 having first and second legs 182, 184 corresponding generally to sides 158 and 160, above. Structural member 172 may have the a form generally corresponding to first part 144, including any kink or dog leg to facilitate mating engagement with main decking section 82, as may be. Structural member 172 may extend slightly beyond the tips of the toes of legs 182, 184, those tips abutting the back side of member 172, with appropriate fillet welds being made. Member 172 need not be of the same thickness of material as member 174. In one embodiment it may be somewhat thinner. On assembly, the margins of member 172 are welded to the downwardly facing surface of main decking member 82.

Figure 3F:
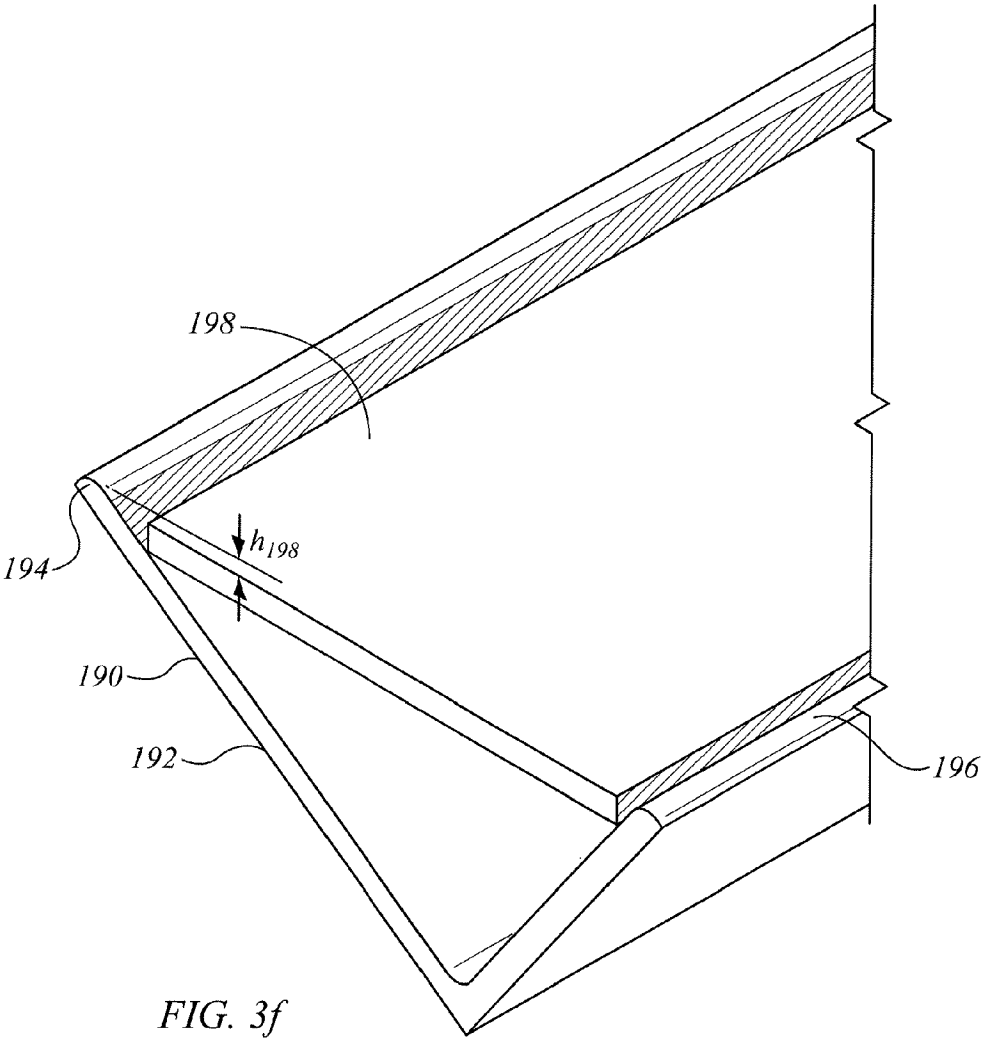
FIG. 3*f* shows a further alternative stringer to that of FIG. 3*a.*

In this alternative, the uppermost side defined by structural member 172 extends beyond the tips of the open section of structural member 174. In the further alternative of FIG. 3*f* there is a two-part section 190 that includes a first member 192, it being an open hollow formed structural member, such as a channel or angle iron, having spaced apart toes 194, 196. However the spanning, or closing member, identified as plate 198, is welded to the inside of toes 194, 196. Plate 198 may be shy of a tangent line drawn across toes 194, 196 by some distance $h_{198}$. Plate 198 may be flat, i.e., planar. Section 190 may be welded to the underside of main decking sheet 82 and accommodate a discontinuity in curvature, or an asperity in structure within the space provided by $h_{198}$. In this circumstance, toes 194, 196 are welded to the downwardly facing surface of main decking sheet 82. As before, section 190 may be substantially triangular, and it is understood that section 190 is provided as a complete, pre-fabricated closed section.

Any closed-section stringer would provide the advantages of this feature. An open-section design that had the opening at the bottom would provide some of this feature's advantages, but not completely.

Various embodiments have been described in detail. Since changes in and or additions to the above-described examples may be made without departing from the nature, spirit or scope of the invention, the invention is not to be limited to those details.

We claim:

1. An autorack rail road car deck assembly for mounting to a framework of a rack of an autorack car, said autorack car having a lengthwise rolling direction, and a direction cross-wise to the rolling direction, and wherein said deck assembly comprises:

at least a first decking member for mounting in a position supported by said framework;

said decking member having undulations, said undulations being oriented cross-wise;

at least a first stringer, said first stringer being oriented lengthwise;

said first stinger having a hollow cross-section of closed periphery;

said decking member having a central portion and at least a first side margin, said first side margin running lengthwise along said central portion and meeting said central portion at a first transition, at which there is a first slope change in said decking member in the cross-wise direction; and said first stringer overlaps said first transition.

2. The autorack rail road car deck assembly of claim 1 wherein said first stringer has capped ends.

3. The autorack rail road car deck assembly of claim 1 wherein said first stringer is made of a roll-formed section.

4. The autorack rail road car deck assembly of claim 3 wherein said roll-formed section has ends butt-welded together.

5. The autorack rail road car deck assembly of claim 3 wherein said roll-formed section has first and second legs that are roll-formed inwardly to lie against each other, and an external weld is formed along a seam where the two legs meet.

6. The autorack rail road car deck assembly of claim 1 wherein said first stringer includes at least a first member and a second member, said first and second members co-operating to form respective first and second portions of said closed periphery of said hollow cross-section.

7. The autorack rail road car of claim 6 wherein said first member defines an open-section member having opposed first and second longitudinally running margins, and said second member defines a closure plate welded across said margins to close said section.

8. The autorack railroad car deck assembly of claim 1 wherein said stringer is substantially triangular in cross-section.

9. The autorack rail road car deck assembly of claim 1 wherein said first decking member has an upper surface over which wheeled vehicles may be conducted, and an opposed underside facing downwardly, and said first stringer is mounted on the underside of said first decking member.

10. The autorack rail road car deck assembly of claim 1 further comprising a second stringer, wherein said first and second stringers are mounted to said deck member in a lengthwise-running, cross-wise spaced-apart symmetrical arrangement.

11. The autorack rail road car deck assembly of claim 1 wherein said undulations of said first decking member define corrugations, said corrugations being oriented cross-wise, and said stringer is mounted to an underside thereof, said stringer running square to said corrugations.

12. The autorack rail road car deck assembly of claim 1 wherein said closed periphery includes a first portion for placement in mating engagement with said first decking member, and said first portion of said closed periphery includes a first part and a second part, there being slope discontinuity as between said first part and said second part.

13. The autorack rail road car deck assembly of claim 12 wherein said first and second parts co-operate to form a gull wing-shaped angle in said profile.

14. The autorack rail road car deck assembly of claim 1 wherein:

said first deck member defines a roadway over which to conduct wheeled vehicles in the lengthwise direction;

there are at least first and second stringers;

said first deck member has a central portion and first and second side margins, said first and second side margins running lengthwise along said central portion;

said first and second side margins each meeting said central portion at respective first and second slope changes in said first decking member in the cross-wise direction;

said first stringer under-girds said first slope change of said first decking member; and said second stringer under-girds said second slope change of said first decking member.

15. The autorack rail road car deck assembly of claim 1 wherein said closed periphery includes a first portion, said first portion of said closed periphery has a first part and a second part, there being slope discontinuity as between said first part and said second part, said first part of said first portion conforming to, and being mated to, said first side margin of said decking member; and said second part of said first portion conforming to, and being mated to, said central portion of said decking member.

16. The autorack rail road car deck assembly of claim 15 wherein said first and second parts co-operatively define a reflex angle in said profile.

17. The autorack railroad car deck assembly of claim 1 wherein:

said central portion of said decking member is crowned;

said first side margin of said decking member is predominantly horizontal;

said first slope change is a slope discontinuity;

said first stringer is mounted underneath said slope discontinuity;

first stringer has an upwardly facing wall that has a first part and a second part;

said first part of said upwardly facing wall conforms to, and is mounted to, said first side margin of said decking member;

said second part of said upwardly facing wall conforms to, and is mounted to, said central portion of said decking member.

18. The autorack rail road car deck assembly of claim 17 wherein:

said first and second parts of said upwardly facing wall are angled relative to each other to form a gull-wing shape; and said stringer is a roll formed section in which said roll-formed section has first and second legs that are roll-formed inwardly toward each other, and an external weld is formed along a seam where the two legs meet.

19. An autorack rail road car deck assembly for mounting to a framework of a rack of an autorack car, said autorack car having a lengthwise rolling direction, and a direction cross-wise to the rolling direction, and wherein said deck assembly comprises:

at least a first decking member for mounting in a position supported by said framework;

said decking member having undulations, said undulations being oriented cross-wise;

at least a first stringer, said first stringer being oriented lengthwise;

said first stinger having a hollow cross-section of closed periphery;

said first deck member defines a roadway over which to conduct wheeled vehicles in the lengthwise direction;

there are at least first and second stringers;

said first deck member has a central portion and first and second side margins, said first and second side margins running lengthwise along said central portion;

said first and second side margins each meeting said central portion at respective first and second slope changes in said first decking member in the cross-wise direction;

said first stringer under-girds said first slope change of said first decking member; and said second stringer under-girds said second slope change of said second decking member;

said central portion of said deck member is crowned;

said side margins meet said central portion at respective first and second transitions;

said first and second side margins are mated to said central portion such that said side margins extend in a common, substantially horizontal plane; and said first and second stringers overlap said first and second transitions, respectively.

20. The autorack rail road car deck assembly of claim 19 wherein each of said first and second stringers has a first portion having a reflex angle formed therein to mate with the transition associated therewith.

* * * * *